United States Patent [19]

Hacker et al.

[11] 4,138,181

[45] Feb. 6, 1979

[54] RELEASABLE ELECTRICAL CONNECTOR

[75] Inventors: John R. Hacker; Chris W. Krohne; William H. Miller, all of Indianapolis, Ind.

[73] Assignee: The United States of America as represented by the Secretary of the Navy, Washington, D.C.

[21] Appl. No.: 899,945

[22] Filed: Apr. 25, 1978

[51] Int. Cl.[2] ..... H01R 13/62

[52] U.S. Cl. ..... 339/45 R; 339/90 C

[58] Field of Search ..... 339/45 R, 45 M, 46, 339/90 C

[56] References Cited

U.S. PATENT DOCUMENTS

| | | | |
|---|---|---|---|
| 3,452,316 | 6/1969 | Panek et al. | 339/45 |
| 3,680,033 | 7/1972 | Kawai | 339/46 |
| 3,953,098 | 4/1976 | Avery et al. | 339/45 R |

*Primary Examiner*—Neil Abrams

*Attorney, Agent, or Firm*—R. S. Sciascia; Paul S. Collignon

[57] ABSTRACT

A releasable electrical connector having a receptacle component and a plug component which can be mated and disconnected by relative rotation between components and can be separated by a straight breakaway force. The receptacle component is provided with bayonet pins that engage semicircular holes in a spring-biased sleeve positioned in the plug component. One end of the spring-biased sleeve is divided into sections and two opposed sections are permanently bent outwardly at an angle sufficiently large so as to clear the bayonet pins on the receptacle component. The semicircular holes used for locking the bayonet pins are provided in the bent sections and a boss on the interior surface of the plug component compresses the bent sections to lock the bayonet pins in the semi-circular holes. A breakaway force moves the sleeve outwardly from the boss and, when the bent sections clear the boss, the resilient bent sections spring outwardly to release the bayonet pins.

12 Claims, 6 Drawing Figures

RELEASABLE ELECTRICAL CONNECTOR

BACKGROUND OF THE INVENTION

The present invention relates to an electrical connector and more particularly to a releasable connector having a lanyard associated therewith.

Release-type electrical connectors are well-known in the art and one use has been with a fuel tank or a missile which is to be jettisoned or launched from an aircraft.

Many quick-release type of electrical connectors have been in use, one of which is a ball-groove type. One such ball-groove type is shown and described in U.S. Pat. No. 3,678,439, entitled, "Quick-Release Electrical Connector", which issued July 18, 1972, to Ottomar H. Vetter. In this patented connector, a coupling ring is provided that is rotated or twisted in the usual manner to effect the mating of the two connector components. During the coupling, the balls are already received in a circumferential groove, and act as mechanical intermediary to advance the associated connector component into its mated condition with the other component. A simple axial pull of sufficient magnitude is all that is required to achieve the release. The balls, during the connector's release or separation, move with the grooved component and are then cammed outwardly, thereby providing positive assurance that the balls no longer interfere with the full release. The same camming means permits the balls to be later shifted back into the groove for subsequent re-use of the connector. Any recoupling of the connector is then performed in the same manner as initially done.

Another type of quick-disconnect connector uses a resilient element that, when unconfined, springs outwardly to provide a release between a receptacle and a plug. One such type connector is shown and described in U.S. Pat. No. 3,452,316, entitled, "Peripheral Threaded Tang Quick-Disconnect Umbilical Connector", which issued June 24, 1969, to George J. Panek and Aloysius M. Mocek. In this umbilical connector, a number of tangs are provided on a plug for threaded receipt onto a mating connector. A shell disposed about the tangs is movable from a first position holding the tangs in threaded engagement with the mating connector to a second position releasing the tangs and permitting them to spring outwardly by inherent resilience to disengage the mating connector.

SUMMARY OF THE INVENTION

The present invention relates to a releasable connector having a mating receptacle and plug which can be coupled and uncoupled by relative rotation between the two components but also can be disconnected by a breakaway force applied axially to the two components.

A receptacle component, which might be attached to a store which is to be separated from an aircraft, is provided with a pair of bayonet pins that engage semi-circular holes in a spring-biased sleeve positioned in a plug component. One end of the spring-biased sleeve is divided into sections and two opposed sections are permanently bent outwardly at an angle sufficiently large so as to clear the bayonet pins on the receptacle component. The semi-circular holes used for locking the bayonet pins are provided in the bent sections and a boss on the interior surface of the plug component compresses the bent sections to lock the bayonet pins in the semi-circular holes. A breakaway force moves the sleeve outwardly from the boss and, when the bent sections clear the boss, the resilient bent sections spring outwardly to release the bayonet pins.

It is therefore a general object of the present invention to provide mating connector components which can be coupled and uncoupled by relative rotation between the two components but which also can be separated by a force applied axially between the two components.

Other objects, advantages and novel features of the present invention will become apparent from the following detailed description of the invention when considered in conjunction with the accompanying drawings.

DESCRIPTION OF THE PREFERRED EMBODIMENT

Figure 1:
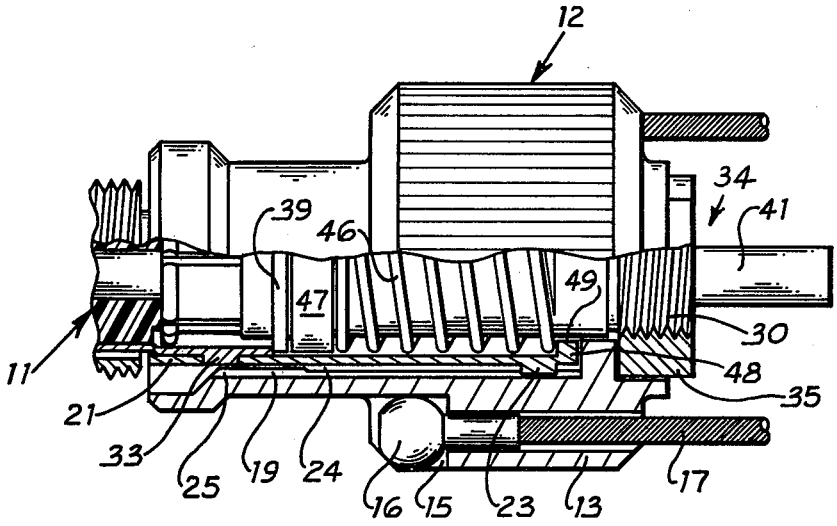
FIG. 1 is a partial sectional view of a preferred embodiment showing a receptacle and a plug in a mating position.

Referring now to the drawings, there is shown a connector assembly comprised of a receptacle component 11 and a mating plug component 12. By way of example, receptacle component 11 might be attached to an object, such as a missile or fuel tank, which is to be launched or jettisoned from an aircraft and the connector assembly forms part of an assembly for providing electrical communication between the object being carried and the aircraft. The embodiment of the present invention is shown in plug component 12.

Figure 5:
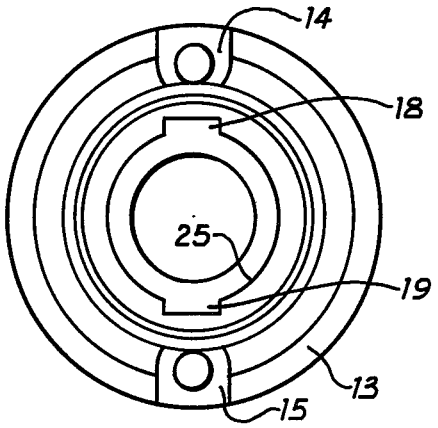
FIG. 5 is an end view of a connector shell.

Plug component 12 has an outer shell 13 which is provided with two bores 14 and 15 which retain balls 16 that are crimped onto a lanyard 17. As best shown in FIG. 5 of the drawings, a pair of opposed grooves 18 and 19 are provided in shell 13. A sleeve 21 is positioned within shell 13 and is provided with a pair of buttons 22 and 23 which are slidably movable in grooves 18 and 19, respectively and prevent any rotation of sleeve 21. Bore 24 of shell 13 provides a loose fit for sleeve 21, however, a boss 25 is provided on the inside surface of bore 24 to prevent the spreading of sleeve 21 when sleeve 21 is fully positioned within shell 13.

Figure 2:
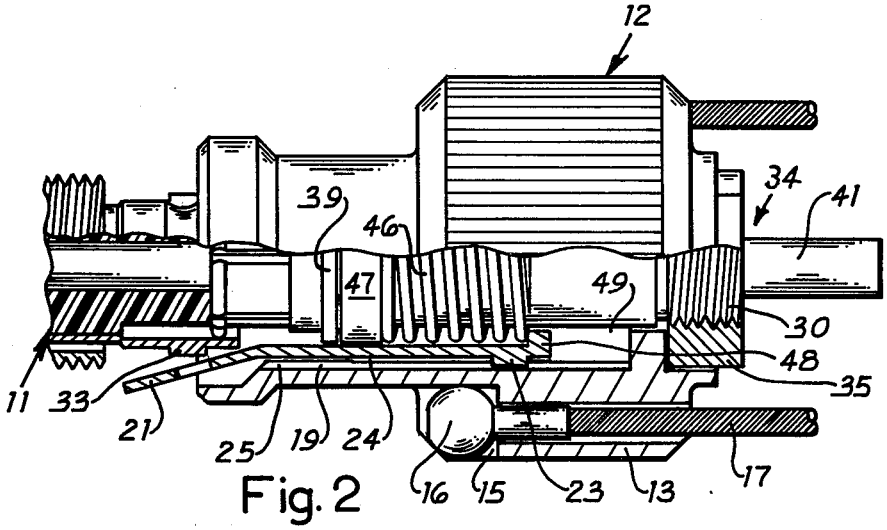
FIG. 2 is a view similar to FIG. 1, only showing a receptacle and a plug in a separating condition.
Figure 3:
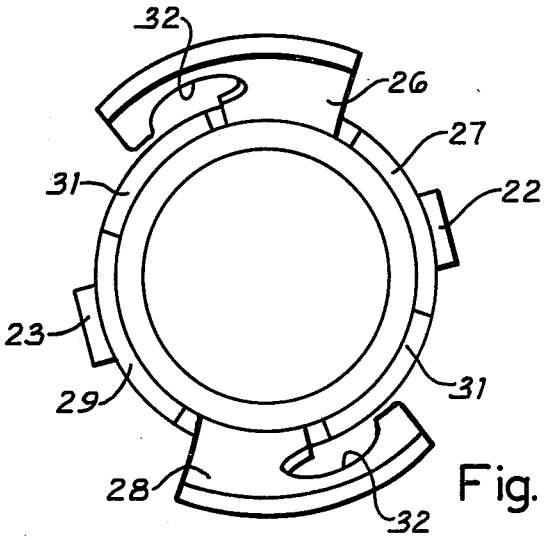
FIG. 3 is an end view of a sleeve coupling.
Figure 4:
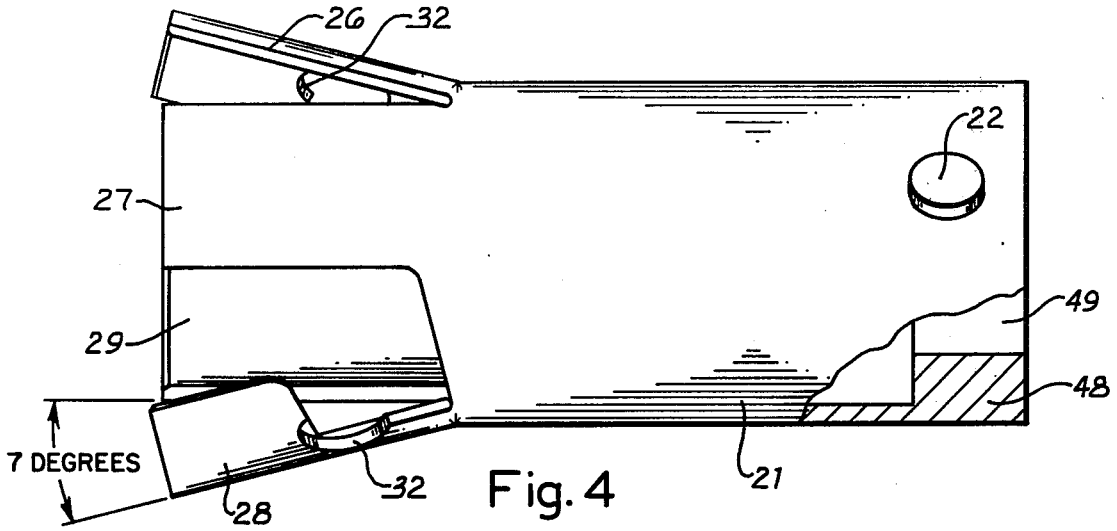
FIG. 4 is a side view of the sleeve coupling shown in FIG. 3.

Referring now to FIGS. 3 and 4 of the drawings, which show sleeve 21 in greater detail, the open end of sleeve 21 is slotted to provide four separated sections 26, 27, 28, and 29. Sections 26 and 28 are flared outwardly at an angle of seven degrees and each section 26 and 28 is provided with an angled portion 31 which terminates with a semi-circular hole 32. The angled portions 31 are provided to guide bayonet pins 33 on receptacle component 11 into holes 32 thereby locking receptacle component 11 with plug 12 when sleeve 21 is fully positioned within shell 13, as shown in FIG. 1 of the drawings. Sleeve 21 is preferably made of beryllium copper which has been heat treated so that flanged sections 26 and 28 remain resilient and can spring outwardly when sleeve 21 moves outwardly from shell 13, as shown in FIG. 2 of the drawing. The seven degree angle for sections 26 and 28 provides sufficient spread for sections 26 and 28 so that bayonet pins 33 are cleared from holes 32 when the open end of sleeve 21 extends from shell 13.

Figure 6:
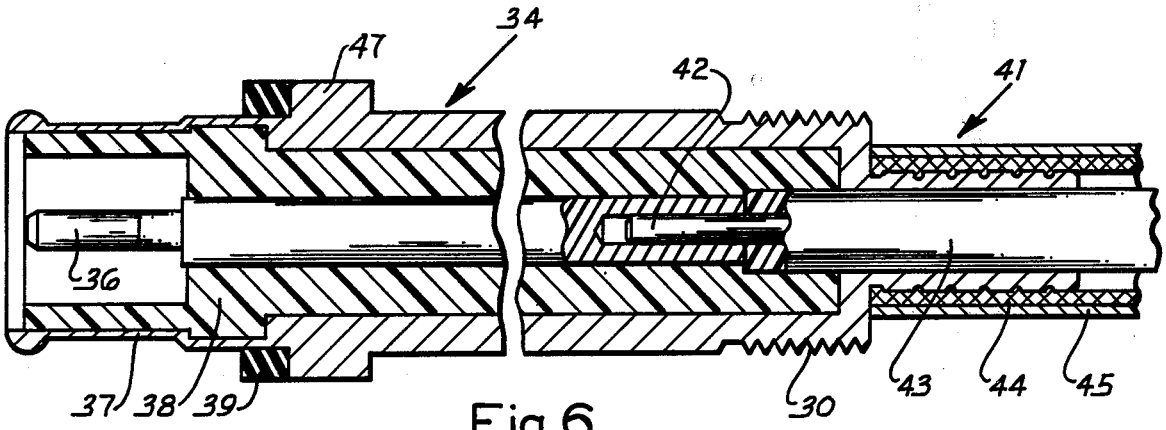
FIG. 6 is a sectional view of the coaxial conductors of a plug component.

Referring now to FIGS. 1, 2 and 6 of the drawings, a male connector body 34 is provided within shell 13 and held attached thereto by nut 35 which engages threads 30. Connector body 34 is a coaxial connector plug and has an inner conductor 36 and an outer conductor 37 which are separated by an insulator 38. A sealing ring 39 is provided on outer conductor 37 for providing a seal between the ends of receptacle 11 and plug 12. A coaxial cable 41, comprised of inner conductor 42, insulator 43, shielding wire 44 and outer conductor 45, is attached to connector body 34 by soldering and crimping so that inner conductors 36 and 42 are electrically connected and also so that outer conductors 37 and 45 are electrically connected. A spring 46 is provided around male connector body 34 between shoulder 47 on connector body 34 and the partially closed end 48 on sleeve 21. Partially closed end 48 has an opening 49 sufficiently large to permit the end of connector body 34 to pass therethrough, however, spring 46 is retained and biases connector body 34 toward receptacle 11.

OPERATION

In operation, assuming the releasable electrical connector is used on an aircraft, receptacle component 11 would be fastened to a store such as a missile or a gas tank, which may be released from the aircraft during flight. Coaxial cable 41 on the end of plug component 12 would be electrically connected with a desired part of the aircraft electrical wiring system and lanyard 17 would be fastened to a stationary part of the aircraft. For example, when used in a bombing mission, the connector assembly would function to electrically arm the bomb prior to drop. Receptacle component 11 would be attached to a bomb and lanyard 17 would be attached to the bomb ejection rack.

Receptacle component 11 and plug component 12 are mated together by pushing and turning plug component 12 into receptacle component 11 so that electrical contact is made between the inner conductors on the receptacle and plug and also between the outer conductors. Bayonet pins 33 on receptacle component 11 pass through a spacing between sections 27 and 28 of sleeve 21 and also through a spacing between sections 29 and 26 and, upon rotation of plug component 12, bayonet pins 33 on receptacle component 11 are guided by angled portions 31 on sleeve 21 so that bayonet pins 33 lock into semi-circular holes 32. With sleeve 21 being fully positioned in outer shell 13, as shown in FIG. 1 of the drawings, boss 25 in shell 13 keeps sections 26 and 28 compressed and thus bayonet pins 33 are locked into semi-circular holes 32. Plug component 12 can be removed from receptacle component 11 by rotating plug 12 in a direction reverse from the direction turned to lock the two components together. Bayonet pins 33 are moved from holes 32 and when these pins 33 are aligned in the spaces between adjacent sections of sleeve 21, the two components 11 and 12 can be separated.

Assuming now that the store holding receptacle component 11 is dropped from the carrying aircraft, shell 13 is restrained from travel by lanyard 17. When receptacle component 11 moves away from plug component 12, bayonet pins 33, which are engaged in holes 32, exert a pulling force on sleeve 21 thereby compressing spring 46, and sleeve 21 moves outwardly from shell 13. When sections 26-29 of sleeve 21 clear boss 25, sections 26 and 28 spring outwardly, as shown in FIGS. 2, 3, and 4, and bayonet pins 33 are clear from sleeve 21. Upon separation of receptacle component 11 from plug component 12, spring 46 moves sleeve 21 back into shell 13 and plug component 12 is reuseable.

It can be seen that, upon release of a store to which receptacle component 11 is attached, separation of receptacle component 11 and plug component 12 does not begin until shell 13 is restrained by lanyard 17. In one use, then, a relatively long lanyard 17 could be supplied, and the final electric energization, such as arming of a fuze, could be delayed until it is assured that the store is in a free-fall condition. Thus having an armed bomb hung-up in a bomb rack could be avoided as the bomb, or other missile, would not be armed prior to free flight of the weapon.

It can thus be seen that the present invention provides a releasable connector which can be engaged and disengaged by relative rotation between two mating components, but, when desired, can also be disengaged by a straight forward pull and without any loss of parts and without damage whereby the releasable connector is reuseable.

Obviously many modifications and variations of the present invention are possible in the light of the above teachings. It is therefore to be understood that the invention may be practiced otherwise than as specifically described.

We claim:

1. A releasable connection for electrical conductors comprising, interengageable plug and receptacle components each including an electrical insulator supporting at least one electrical contact member arranged for interconnection when said plug and receptacle components are brought into interengagement, locking means on said receptacle component, a plug shell concentrically surrounding said electrical insulator in said plug component, a cylindrical sleeve movably positioned in said plug shell, said cylindrical sleeve having one end slotted to provide a plurality of separated sections at least two of which are flared outwardly beyond the normal diameter of said cylindrical sleeve, locking means on said at least two outwardly extending flared sections arranged for engagement with said locking means on said receptacle component, compressing means in said plug shell for compressing said outwardly extending flared sections to maintain engagement of said locking means on said receptacle component with said locking means on said at least two outwardly extending flared sections, and spring means for biasing said movable cylindrical sleeve into a position whereby said outwardly extending flared sections are compressed to keep said locking means on said plug and said locking means on said receptacle engaged with one another until a separating force between said plug and receptacle components becomes sufficiently large to compress said spring means and move said cylindrical sleeve a sufficient distance so that said flared sections clear said compressing means thereby unlocking said locking means on said receptacle component from said locking means on at least two outwardly extending flared sections.

2. A releasable connection for electrical conductors as set forth in claim 1 having a lanyard attached to said plug shell for applying a separating force between said plug and receptacle components.

3. A releasable connection for electrical conductors as set forth in claim 1 wherein said cylindrical sleeve is made of beryllium copper.

4. A releasable connection for electrical conductors as set forth in claim 1 having means for preventing relative rotation between said plug shell and said movable cylindrical sleeve.

5. A releasable connection for electrical conductors as set forth in claim 1 wherein said locking means on said receptacle component comprises a pair of oppositely positioned and outwardly extending bayonet pins and said at least two outwardly extending flared sections extend sufficiently outwardly so that said locking means in said two outwardly extending flared sections will disengage said bayonet pins whenever said cylindrical sleeve is unconfined.

6. A releasable connection for electrical conductors as set forth in claim 5 wherein said locking means on each said outwardly extending flared sections includes a semi-circular hole and wherein an angled surface is provided between an adjacent slot and said semi-circular hole for guiding a bayonet pin into said hole when said plug component is rotated relative to said receptacle component.

7. A releasable connector plug for engagement with a receptacle having a pair of outwardly extending bayonet pins comprising, a plug shell, a contact assembly comprised of an inner conductor and an outer conductor separated by an electrical insulator, said contact assembly being concentrically mounted within said plug shell, a cylindrical sleeve slidably positioned between said plug shell and said outer conductor of said contact assembly, said cylindrical sleeve having one end slotted to provide a plurality of separated sections at least two of which are flared outwardly beyond the normal diameter of said cylindrical sleeve, locking means on said at least two outwardly extending flared sections arranged for engagement with bayonet pins on a receptacle, compressing means in said plug shell for compressing said outwardly extending flared sections to maintain engagement of bayonet pins on a receptacle with said locking means on said at least two outwardly extending flared sections, and spring means for biasing said movable cylindrical sleeve into a position whereby said outwardly extending flared sections are compressed to keep said locking means on said plug and bayonet pins on a receptacle engaged with one another until a separating force between said plug and receptacle becomes sufficiently large to compress said spring means and move said cylindrical sleeve a sufficient distance so that said flared sections clear said compressing means thereby unlocking said bayonet pin on a receptacle from said locking means on at least two outwardly extending flared sections.

8. A releasable connector plug as set forth in claim 7 having a lanyard attached to said plug shell for applying a separating force between said plug and a mating receptacle.

9. A releasable connector plug as set forth in claim 7 wherein said cylindrical sleeve is made of beryllium copper.

10. A releasable connector plug as set forth in claim 7 having means for preventing relative rotation between said plug shell and said slidable cylindrical sleeve.

11. A releasable connector plug as set forth in claim 7 wherein said locking means on each said outwardly extending flared section includes a semi-circular hole and wherein an angled surface is provided between an adjacent slot and said semi-circular hole for guiding a bayonet pin on a receptacle into said hole when said plug is rotated relative to said receptacle.

12. A releasable connector plug as set forth in claim 7 wherein said at least two outwardly extending flared sections extend sufficiently outwardly so that said locking means in said two outwardly extending flared sections will disengage bayonet pins on a receptacle whenever said cylindrical sleeve is unconfined.

* * * * *